US009389048B2

(12) United States Patent
Revord

(10) Patent No.: US 9,389,048 B2
(45) Date of Patent: Jul. 12, 2016

(54) NUCLEAR MISSILE FIRING CONTROL AND INVENTORY REDUCTION SYSTEM

(71) Applicant: Raoul D. Revord, Wetmore, MI (US)

(72) Inventor: Raoul D. Revord, Wetmore, MI (US)

( * ) Notice: Subject to any disclaimer, the term of this patent is extended or adjusted under 35 U.S.C. 154(b) by 97 days.

(21) Appl. No.: 14/742,779

(22) Filed: Jun. 18, 2015

(65) Prior Publication Data

US 2016/0047635 A1 Feb. 18, 2016

Related U.S. Application Data

(60) Provisional application No. 62/013,653, filed on Jun. 18, 2014.

(51) Int. Cl.
*F41H 13/00* (2006.01)

(52) U.S. Cl.
CPC ..... *F41H 13/00* (2013.01)

(58) Field of Classification Search
CPC ..... F41H 13/00
USPC ..... 89/1.11
See application file for complete search history.

(56) References Cited

U.S. PATENT DOCUMENTS

| | | | |
|---|---|---|---|
| 2,399,426 | A | 4/1946 | Bradley |
| 3,848,193 | A | 11/1974 | Martin et al. |
| 4,093,153 | A | 6/1978 | Bardash et al. |
| 4,726,224 | A | 2/1988 | D'Ausilio |
| 5,046,006 | A | 9/1991 | Revord et al. |
| 5,206,452 | A | 4/1993 | Stamper et al. |
| 5,937,001 | A | 8/1999 | Shockey |
| 6,166,653 | A | 12/2000 | Schulmeyer et al. |
| 6,392,558 | B1 | 5/2002 | Schulmeyer et al. |
| 6,986,302 | B2 | 1/2006 | LaFata |
| 7,047,861 | B2 | 5/2006 | Solomon |
| 7,687,750 | B2 | 3/2010 | Revord |
| 2005/0183569 | A1 | 8/2005 | Solomon |

*Primary Examiner* — Reginald Tillman, Jr.
(74) *Attorney, Agent, or Firm* — Dinsmore & Shohl LLP

(57) ABSTRACT

A system under international control is in possession of the firing codes required to launch missiles owned by the parties to the system. Upon a request to the international authority for the release of its firing codes so that it may launch a first strike, the target party is advised of the request and given the opportunity to launch its own missiles first. The system deters first strikes.

16 Claims, 14 Drawing Sheets

FIG 7
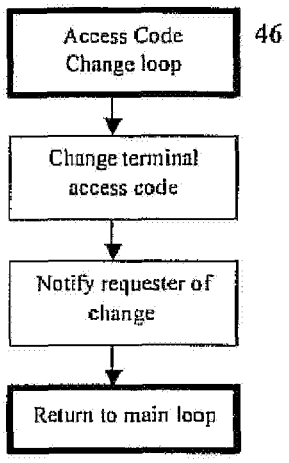
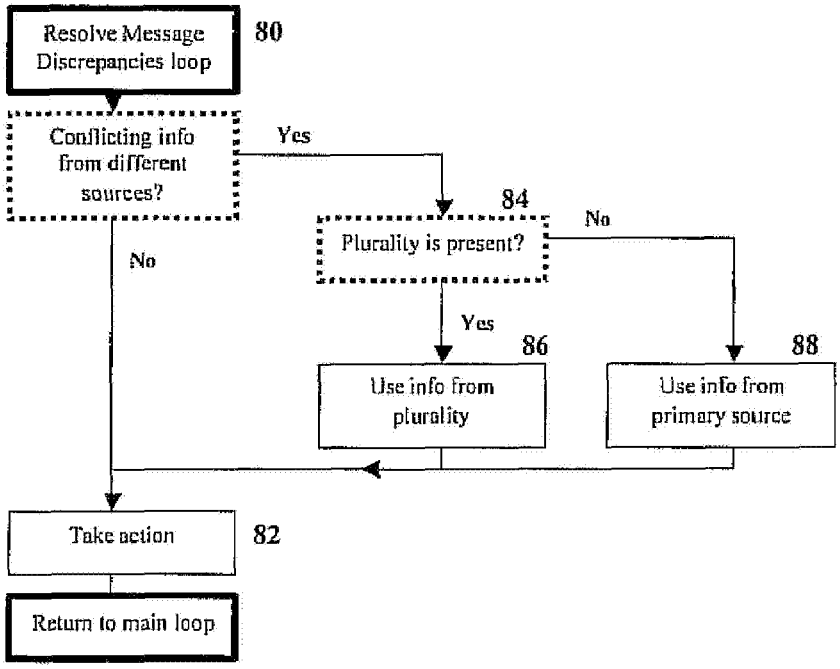
FIG 8

NUCLEAR MISSILE FIRING CONTROL AND INVENTORY REDUCTION SYSTEM

CROSS-REFERENCE TO RELATED APPLICATIONS

This application claims priority of U.S. Provisional Application 62/013,653 filed Jun. 18, 2014, the contents of which are incorporated herein by reference.

FIELD OF THE INVENTION

This invention relates to a missile launch control system and in particular to a system which exercises mutual computer control over the firing of nuclear armaments at each other by a plurality of parties and creates a gradual destruction system for the parties' existing inventory of armaments. More particularly the system of the present invention exercises mutual computer control over missiles in such a way as to highly discourage a first strike.

BACKGROUND OF THE INVENTION

My U.S. Pat. Nos. 5,046,006 and 7,687,750 disclose and claim a system operating under a treaty between nuclear armed states wherein the states would deliver exclusive possession of the firing codes required to launch missiles owned by the parties to a central authority. Upon a request to the international authority for the release of a particular country's firing code so that it may launch a first strike, the target party is advised of the request and given the opportunity to launch its own missiles first. The system would obviously defer first strikes of missiles. However, such a system would do nothing to diminish and ultimately end all inventories of nuclear missiles in the world, which must be the aim of the world community if it is to avoid destruction in a nuclear war.

The previously patented system would be more politically acceptable to nuclear armed states than an agreement among them to all destroy their missile inventories, which is certainly not politically feasible at the present time. However, the previous system could act as a bridge to the reduction of nuclear missile inventories and their ultimate extinction if appropriately modified.

SUMMARY OF THE INVENTION

The present invention therefore contemplates a system which initially delivers the firing codes required for release of nuclear armaments, hereinafter sometimes referred to as "missiles", to a central authority under the conditions set forth in my previous patents, but adds a protocol in which the member countries would be required to each destroy some portion of its nuclear inventory over time. This could take the form of requiring each country to totally incapacitate a certain percentage of missiles in its inventory each year until each country's inventory was down to a single missile which could be kept until all of the other countries had reached that goal at which time each country would destroy its sole remaining missile. Other variations of the diminishment over time scheme are easily visualized.

The permanent incapacitance of any of a country's missiles would then be authenticated by international inspectors authorized to inspect and test the decommissioned missiles to verify their destruction. This information would be provided to the central authority.

The penalty for a country failing to live up to its obligation to diminish its nuclear missile inventory as required by the system could be the refusal of the international authority to release the firing codes of some or all of the missiles under the conditions of the control system specified in my previous patents. Thus, by way of example, if the inventory diminishment timetable required a country to totally incapacitate a certain percentage of its missiles at a particular time, and the country did not meet that requirement, the international authority would refuse to release the firing codes for the missiles that should have been destroyed, under any circumstances, or alternatively, refuse to deliver any firing codes to the party not performing its destruction obligations under the international system.

This arrangement would give comfort to the parties entering the system to give up their firing codes, knowing that they would not be subjected to first strikes by any of the other parties but would have an opportunity to launch their missiles before delivery of firing codes to a party desiring the release of its firing codes so that it might launch a first strike. Similarly, they would feel secure in diminishing their own inventory of missiles knowing that the other parties must either similarly diminish their own missiles or suffer the penalty of the international authority refusing to release firing codes to those parties in accordance with the initial accord.

Taken as a whole, the present system would be a much "easier sell" to nuclear armed states than any other proposal for missile reduction that has been proposed.

BRIEF DESCRIPTION OF THE DRAWINGS

Other objects, advantages and applications of the present invention will be made apparent by the following detailed description of a preferred embodiment of the invention. The description makes reference to the accompanying drawings in which:

FIGS. 4, 5, 6, and 7 are logic flow diagrams of subroutines in the logic flow diagram of FIG. 3;

FIG. 8 is a logic flow diagram of a message discrepancy resolution algorithm;

DETAILED DESCRIPTION OF THE PREFERRED EMBODIMENTS

Figure 1:
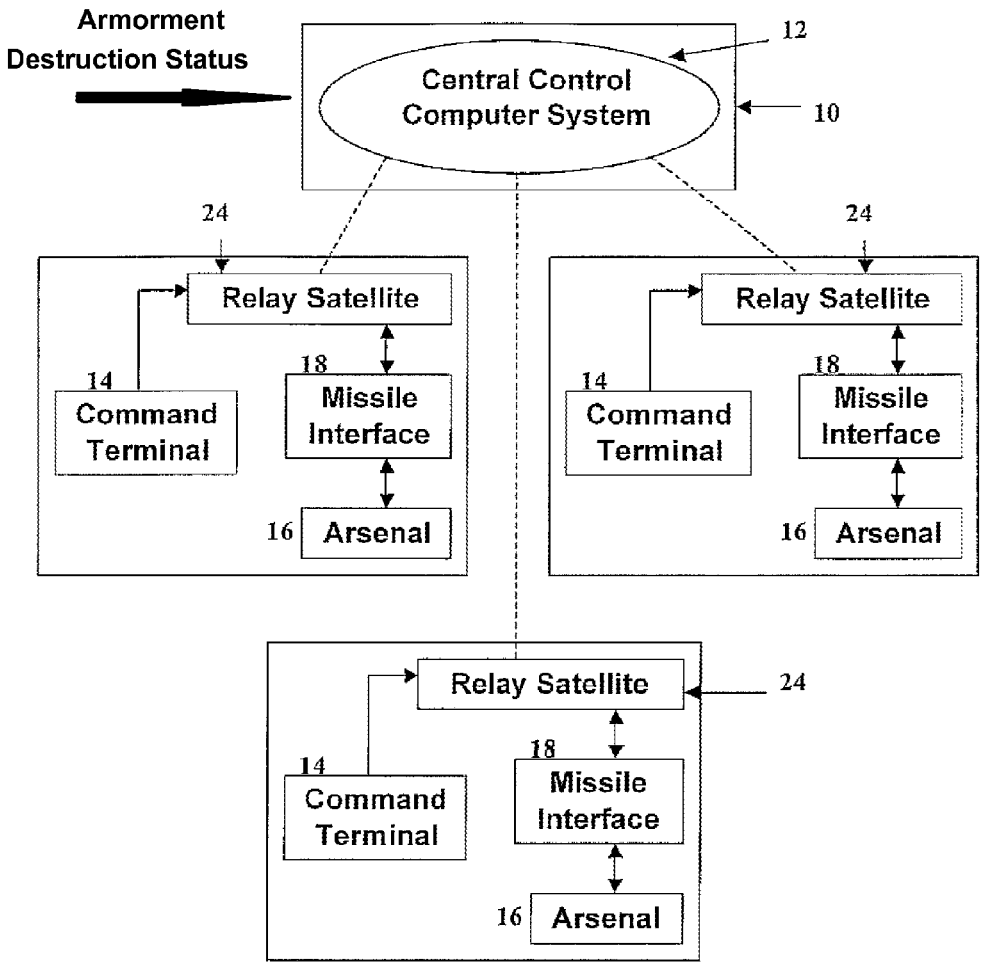
FIG. 1 is a block diagram of the physical arrangement of a first embodiment of my invention.

FIG. 1 depicts an overview of the preferred embodiment of the present invention. A satellite communication system 10, in geosynchronous orbit, contains a central control computer system (CCCS) 12 that is in communication with terminals 14 operated by each of the participating parties. Through these terminals 14, the CCCS 12 is in constant communication with the nuclear arsenals 16 of each party to the treaty through a relay satellite 24, which communicates with the arsenals 16 through missile interfaces 18. The missiles of each arsenal 16 include every missile, whether it be land based, in a submarine, or airborne.

The system illustrated in FIG. 1 is essentially the same as that of my two previous patents, essentially differing in the inclusion of elements which condition the operation of the system upon compliance of the participating parties with a protocol requiring each of the parties to destroy the same part of its nuclear inventory of armaments over time.

This protocol is an agreement among the various participating parties in which they transfer control of their nuclear arsenal to the Central Computer Control System (CCCS) of some international authority. In a preferred embodiment of the invention, this means that individual parties will no longer be in possession of the launch sequences required to fire their missiles, and can only receive them from the CCCS. The CCCS will in turn have a predetermined system protocol agreed upon by the various parties, and any action it takes, such as the release of launch sequences, must be in accord with that protocol.

This periodic destruction would continue until each country's inventory of armaments reached a predetermined minimum number of armaments, such as a single missile or the like, which could be kept until all of the participating parties reach that goal, at which time the protocol preferably requires that all parties simultaneously destroy their remaining inventories. The protocol establishes a corps of inspectors authorized to inspect each party's armament inventory to establish compliance with the destruction requirements. Reports indicating each party's destruction compliance are introduced into the CCCS system 12 at input 11.

In the preferred embodiment of the system, by the protocol, each party is required to destroy a certain percentage of its inventory, such as 10% or at least one missile or the like, each year after joining the protocol.

The CCCS 12 has exclusive control over the launching of each missile. The system is in possession of the launch sequences necessary to launch any missile as well as the targeting data needed to direct it. The possessors of the missiles do not have access to these launch sequences as they have transferred the possession of the sequences to the authority controlling the CCCS under the treaty establishing the system. In order to launch a missile, a possessor must make a request to the CCCS 12 from their terminal 14. Each party has access codes that allow them access to the CCCS 12 from their terminals 14. Authorized personnel of each party can change these access codes at will by a process subsequently described. To further ensure security and limit the terminals' use to authorized personnel, the embodiment may implement innovative positive identification measures, such as palm print, retina, or voice identification. Alternatively, parties may also include remote terminal communication systems, where the parties have access to their terminals from remote locations.

Each missile of the participating parties' arsenals 16 has an on-board computer control system that is interfaced with that missile's detonating mechanism. Each missile control system is in constant communication with the CCCS 12 via a relay satellite 24, and is capable of receiving a launch sequence. The CCCS is capable of transmitting signals that will detonate any missile warhead in any of the arsenals.

The on-board missile computer systems also provide the CCCS information that allows it to monitor whether any missiles are being tampered with. This information preferably includes the monitoring of any entry into the on-board computer system of the missile, any changes in temperature or missile telemetry, the removal of the canopy enclosing the warheads, or any unauthorized attempts to submit launch sequences.

The CCCS will assign every missile in its system an identification code that accompanies every communication between the CCCS and the on-board computer of each missile. The missiles and the CCCS communicate through the relay satellites 24, and the interface between each missile and the CCCS will depend upon the configuration of the missile.

The missiles in each arsenal are in either an inactive state, wherein the missiles are unarmed and unable to be armed and fired, or an active state, wherein the missile interfaces are set up to accept launch sequences provided by the CCCS 12 to the terminal which allows arming and firing. While the present invention is in operation, the CCCS 12 controls the state of and constantly monitors all missiles in the nuclear arsenals 16. If a missile has been fired after the launch sequences have been set up at the missile site, this information is also sent to the CCCS.

Each party is allowed to send a limited set of commands to the CCCS 12 from their terminal 14. These commands include requests to change the CCCS terminal access codes, first-strike missile launch requests, confirmation of first-strike missile launch requests, requests to decommission one or more missiles, consent to a requested decommission, launch sequence requests in retaliation to a first-strike request, requests for ceasefire, and consent to ceasefire requests. In the alternative embodiment in which the switch of one party's firing control system from one state to the other is accompanied by the switch of its allies' firing control systems from the same initial state to the same final state, additional commands to register or deregister ally status may be made.

The requests for decommission require the responsive consent of all other parties, in a predetermined time period, before authorization is transmitted from the CCCS. During this predetermined time period, each of the non-requesting parties is capable of issuing a consent pending command from its terminal. This command stops the time elapse and thereby grants the party more time to decide whether to consent to the requested decommission. Any unauthorized attempt to decommission a missile, i.e. to break the communication link between a missile and the CCCS, will result in an appropriate action by the CCCS. Detailed descriptions of CCCS actions will be subsequently disclosed.

Figure 2:
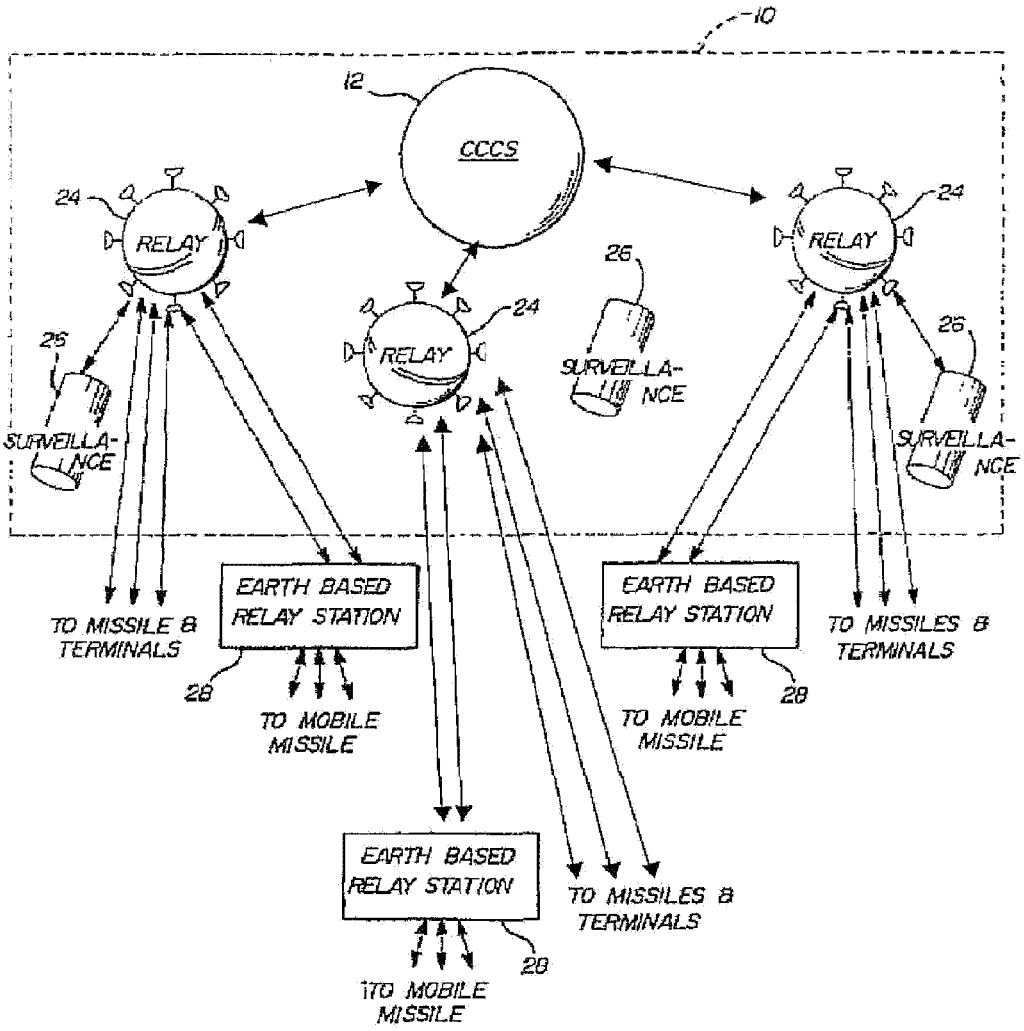
FIG. 2 is a schematic diagram of the satellite communication system in FIG. 1.

FIG. 2 depicts a detailed schematic of the satellite communication system 10. The satellites in 10 are in geosynchronous orbit. The present invention is controlled by the central control computer system satellite (CCCS) 12. The CCCS 12 is deployed so as to be in direct communication with all of the relay satellites 24. The relay satellites 24 deliver all messages received from the command terminals 14, the missile interfaces 18, surveillance satellites 26 and earth-based relay stations 28 to the CCCS.

Figure 9:
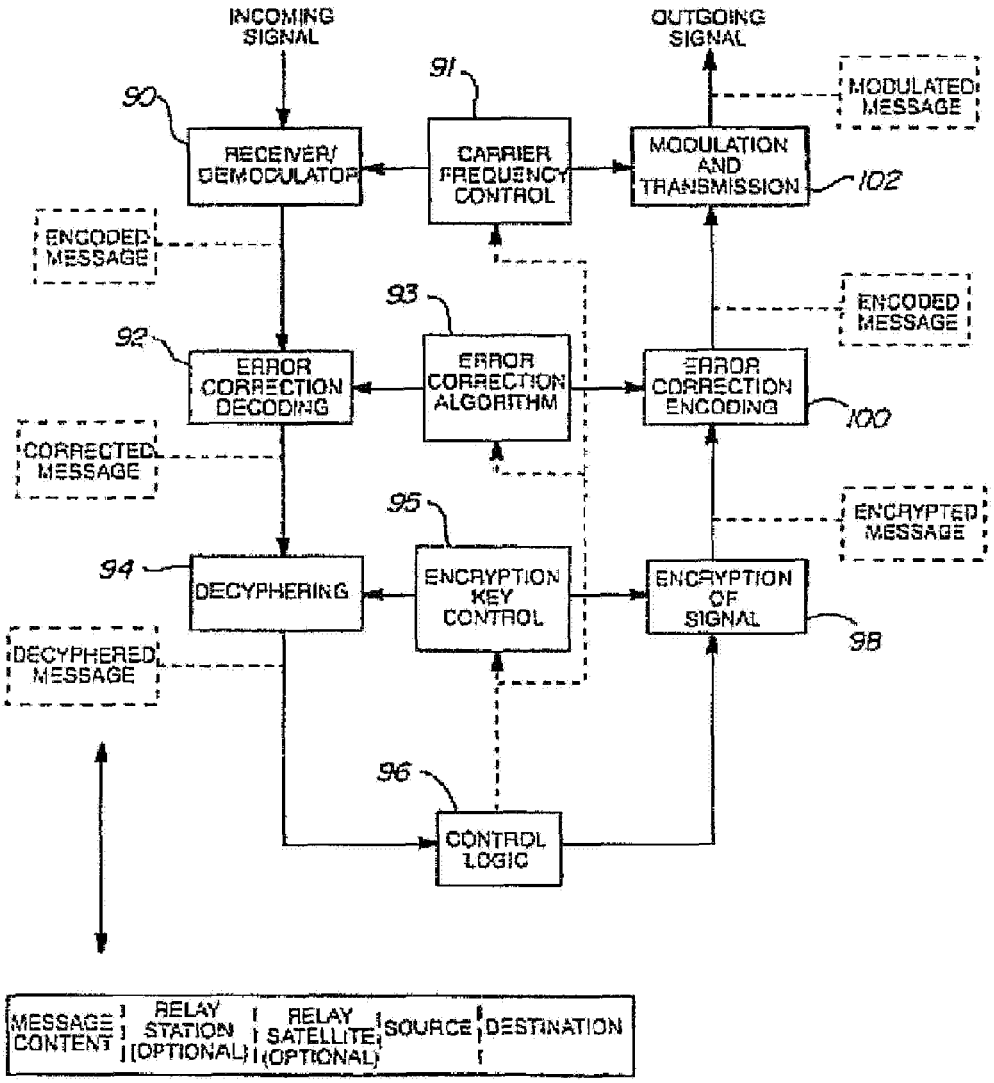
FIG. 9 is a schematic drawing of a communication channel present in each system component of the present invention.

FIG. 9 is a schematic drawing of the communication channel present in each component of the system. After receiving an incoming message or an incoming message with another destination, the component, such as a relay satellite 24, must first demodulate at step 90, decode at step 92, and then decipher at step 94 the message using the frequency band information shown at step 91, the error correction algorithm at step 93 and the encryption key information of step 95 maintained for that communication channel. The interpretation of frequency and encryption information, as well as routing information, is carried out by the control logic 96.

The relay station or satellite or other like component must then examine routing information also contained in the message, i.e., the component to which the message will be transmitted, and direct the message onto the appropriate communication channel. The routing information specifies the path of a message from source to destination. The control logic 96 of the relay satellite 24 associates a specific channel for each possible destination and routes a message accordingly. If a relay satellite or station receives a message over a communication link other than one specified in the message, the control logic 96 appends a new message to the incoming message reporting that the routing path specified in the incoming message was incorrectly followed.

The integrity of the message is preserved by the relay satellite by changing the encryption of the message as it passes onto a new channel as will be explained in detail below. Once the message is passed to the correct channel, the message is queued up for transmission. If all possible channels are in use, the message waits for the next available channel. As shown in FIG. 9, once a channel is clear, the message is encrypted at step 98 using the encryption keys for that channel, encoded at step 100 and transmitted at step 102 to the correct destination using the frequency band, the error correction algorithm 93 and the encryption key information set up for that channel. The relay satellite, through control logic 96, time-multiplexes the messages on each channel so that consecutive or concurrent messages do not interfere or overlap with each other.

As shown in FIG. 2, the preferred embodiment of the present invention also includes earth-based relay stations 28 which function in the same manner as the relay satellites 24. The stations 28 demodulate, decode and decipher signals received from the relay satellites 24 that are intended for the mobile missile sites in the same manner as shown in FIG. 9 for the relay satellites 24. The control logic of the relay station sends messages to their appropriate destination by routing the messages to the appropriate communication channel in the same way as described above and shown in FIG. 9. The control logic manipulates the encryption and frequency band of each channel based on the control messages that it receives. The stations 28 then retransmit these signals on the appropriate frequencies to the appropriate mobile missile sites using the appropriate encryption key. Likewise, signals sent from mobile missile sites that are intended for the relay satellites are received by the stations 28 and retransmitted to the relay satellites 24.

The CCCS satellite 12 is also in communication with surveillance satellites 26 through one or more relay satellites 24. They are in low earth orbit, and will move in and out of a particular relay satellite's communication range. The surveillance satellites 26 use infrared lenses and radar imaging to detect nuclear detonations or rocket launchings on the ground and provide this information to the CCCS.

In the preferred embodiment of the present invention, a unique firing code, the code that must be sent to a missile in order to fire it, is hardwired into each missile. This firing code is known only by the CCCS. When placing the missiles of a party into the active state, the CCCS provides the party, at their terminal, with a randomly generated first set of launch sequences corresponding to each missile. The CCCS derives a corresponding second set of secret launch sequences so that a predefined calculation involving each two corresponding launch sequences results in the firing codes of the corresponding missiles. Thus, the launching sequences are different every time missiles are put into the active state. Each missile interface takes as one input the first launch sequence from the adversary's terminal and as a second input, the second launch sequence from the CCCS. The missile interface performs the predefined calculation on these two sequences and outputs the result to the missile. With the correct sets of launch codes the missile can then be armed and fired. This state remains until the missile is armed or until the CCCS invalidates its set of launch codes. In the preferred embodiment, multiple key techniques of the type commonly used in encryption systems are implemented to perform the calculation.

Figure 3:
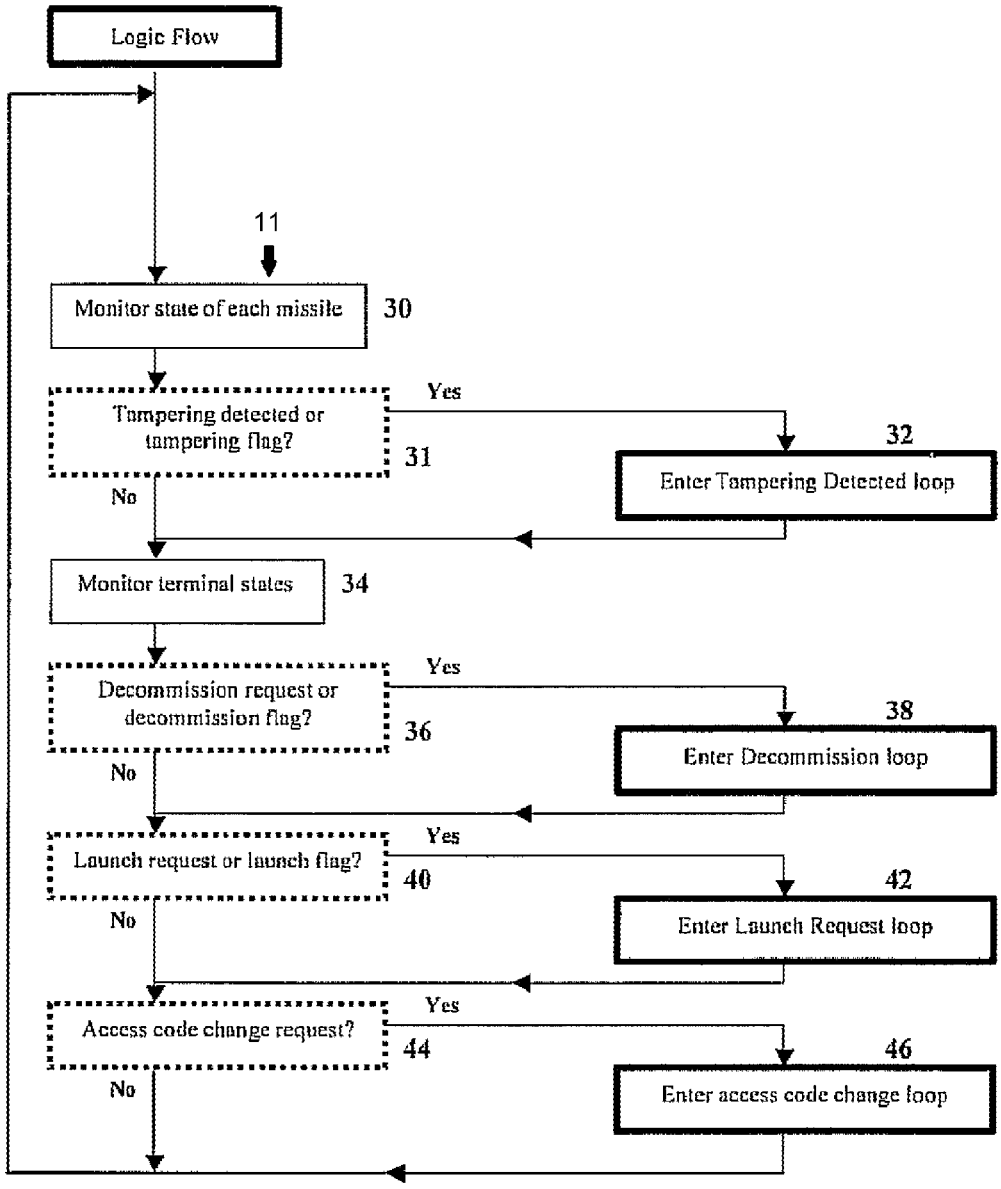
FIG. 3 is a logic flow diagram of the missile control logic algorithm of the present invention.

FIG. 3 depicts the flow diagram for the main loop of the missile control logic algorithm.

The first step of the program is the determination of whether a party requesting release of its firing codes is in compliance with the periodic armament destruction policies of the international protocol. This is based on the information provided by inspection authorities at input 11 of the computer 12 as illustrated in FIG. 1. Only if the requesting party is in compliance does the loop illustrated at FIG. 3 become activated. Otherwise, a message is sent to all parties who are in compliance with the protocol of the request by the noncompliant party and its denial.

The second step of the main loop is indicated at 30 in FIG. 3. At this step, the state of each missile is monitored. The message transmitted from the missile either indicates that the missile status is intact or that some or all of the missiles at that site have been destroyed or decommissioned and the fact of this action has been verified by proper inspection as indicated by input 11 from the CCCS inspectors or, alternatively, there has been tampering with one or more missiles at a site. The tampering of a missile includes an unauthorized attempt to submit a launch sequence to the missile. If the message notes a tampering, all parties are notified through their terminals. If the missile is mobile, then provision must be taken for the possibility of the destruction or the incapacitation of the deployment vehicle. A missile type is determined from its identification code.

Figure 4:
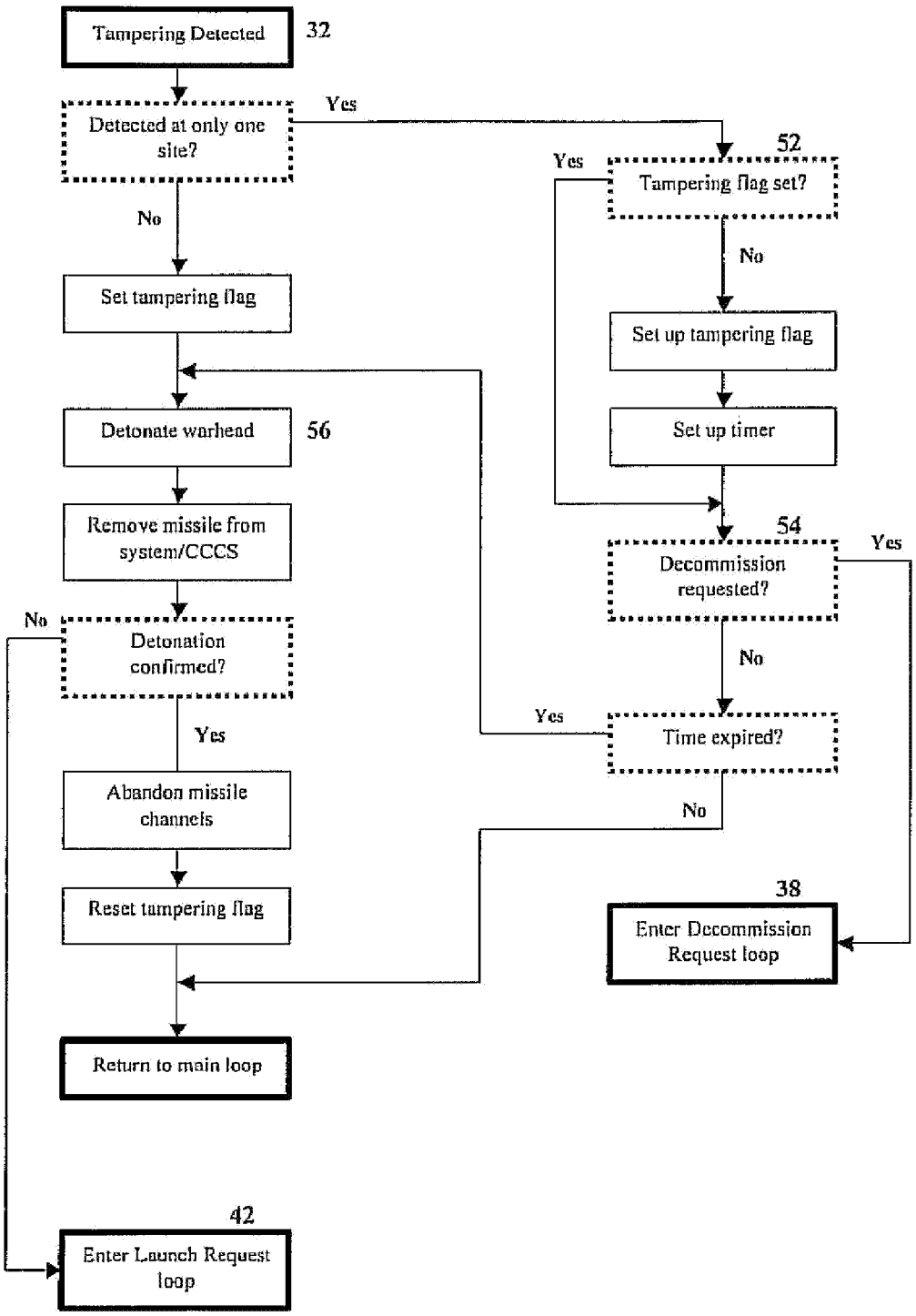

As indicated at 31 and 32 of FIG. 3, when a tampering is detected, the "Tampering Detected" routine is executed. This routine is executed once for each missile where tampering is detected or where a tampering flag, described subsequently, is set. The flow diagram for the "Tampering Detected" algorithm 32 is depicted in FIG. 4.

First, the algorithm checks if tampering has been detected at only one site. This is achieved by utilizing a plurality of global counters, one for each party, that are initialized to zero and are incremented each time there is a tampering detected for the corresponding party. For the purposes of the present invention, a site is defined as either a single land based missile silo, or as a mobile deployment vehicle. All land based sites store only one missile, while mobile sites may have a plurality of missiles. If tampering is detected at more than one site, the algorithm sets the tampering flag and proceeds to the step indicated at 56. If tampering is detected at only one site, the CCCS checks at step 52 if the tampering flag is set. If the flag is set the algorithm proceeds to the step indicated at 54. On the first execution of the routine for the detected tampering, the tampering flag is not set at step 52. If this is the case, the tampering flag is set and a timer is started. The algorithm then goes to the step indicated at 54.

At 54, it is checked whether a decommission has been requested. If so, the "Decommission Request" routine, indicated at 38, is executed. In the case where there are multiple missiles detected of tampering at the same site, then a different decommission request must be made for each of these missiles. If no decommission request is received at 54, it is checked whether the timer has expired. If not, the algorithm returns to the main program of FIG. 3. In this case, the routine will be re-entered on the next iteration of the main loop. If the timer has expired, the algorithm goes to the step indicated at 56.

At 56, the CCCS attempts to detonate all of the warheads at the site in question. Next, the CCCS removes all missiles destroyed by the detonation from the system, and it is checked whether the detonation has been confirmed. Such confirmation can be made by the infrared lenses on the surveillance satellites 26 shown in FIG. 2. If the detonation is verified, the appropriate missile communication channels are abandoned, the tampering flag is reset, and the algorithm returns to the main program of FIG. 3. If the detonation is not confirmed, the "Launch Request" routine 42 is executed and the system acts as if the tampering party has requested a first strike.

At the next step, 34, of the main loop FIG. 3, the states of the command terminals are monitored. The following is a list of all possible valid messages from the terminals:

1. First-strike request;
2. Withdraw first-strike request;
3. Access code changes;
4. Decommission request;
5. Decommission consent;
6. Decommission consent pending;
7. Withdraw decommission consent pending;
8. Launch code release request (in retaliation to first-strike request);
9. Ceasefire request;
10. Ceasefire consent.

Figure 5:
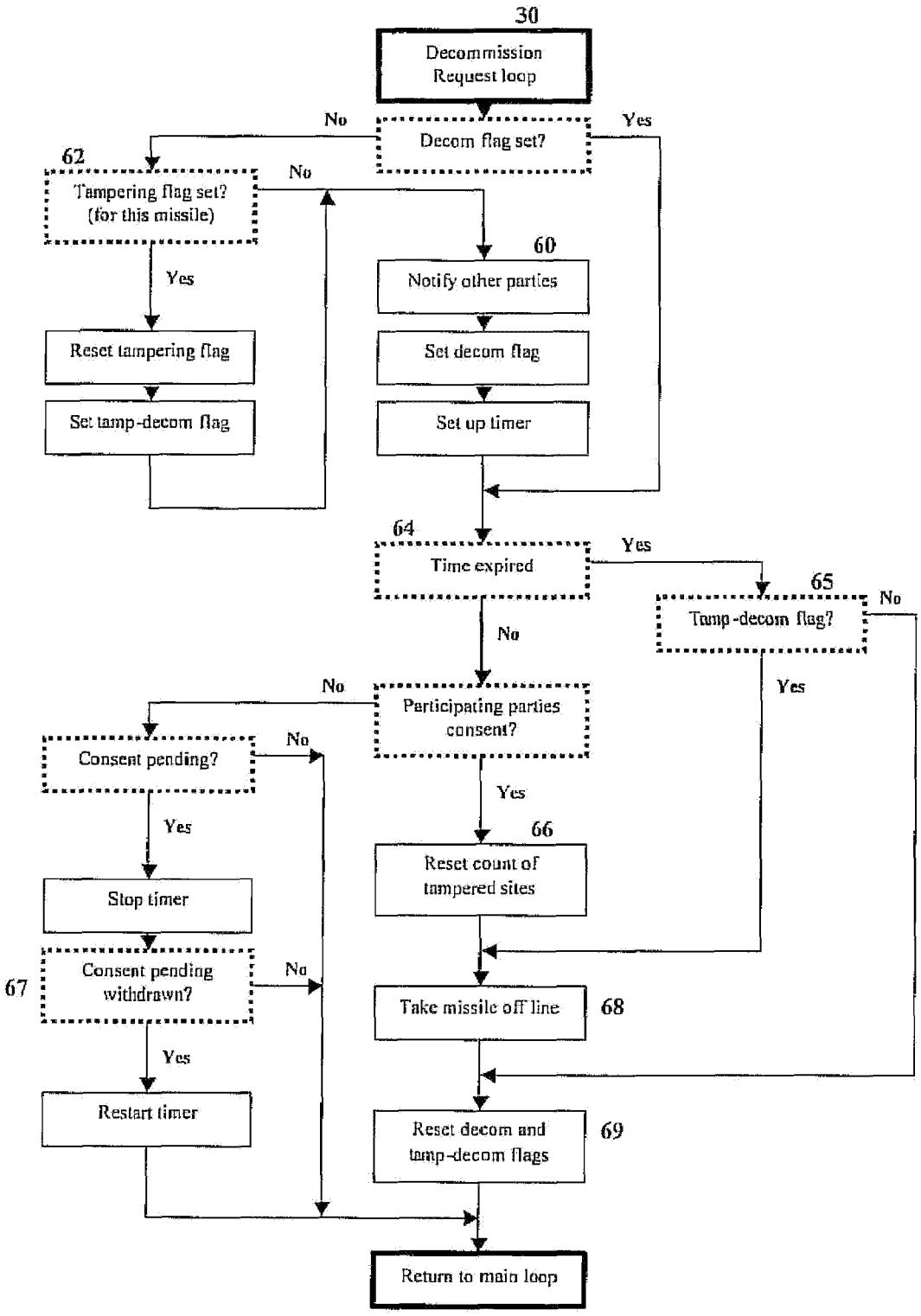

In the alternative embodiment in which the switch of one party's firing control systems from one state to the other is accompanied by the switch of its allies' firing control systems from the same initial state to the same final state, the following two messages are also valid:

11. Request for ally registration;
12. Deregister ally;

As indicated at 36 and 38 of FIG. 3, a request for decommission causes the "Decommission Request" routine to be executed. This routine is also executed if a decommission flag, described subsequently, is set. The flow diagram for the "Decommission Request" algorithm is depicted in FIG. 5. Initially, the algorithm checks whether the decommission flag is set. If the flag is set, the algorithm proceeds to the step indicated at 64. During the first execution of this routine, the flag will not be set. If this is the case, the algorithm goes to the step indicated at 62 and checks if the tampering flag is set. If it is not, the algorithm skips to the step indicated at 60. If the tampering flag is set at 62, the tampering flag is reset and a tampering-decommission flag is set. The algorithm continues with step 60.

At step 60, all other parties are notified of the decommission request. Next, the decommission flag is set, and a timer is started. The next step of the algorithm is indicated at 64.

At step 64, it is checked whether the timer is expired. If it is expired, the algorithm goes to the step indicated at 65. If the timer is not expired at step 64, it is checked whether all other parties have consented to the decommission. If so, the algorithm goes to the step indicated at 66. If unanimous consent has not been received, it is checked whether all the parties that have not consented have issued a consent pending command from their terminal. If not, control is returned to the main loop and the "Decommission Request" routine will be executed again in the next iteration of the main loop. If all parties that had not consented have issued a consent pending command, the timer is stopped and the algorithm goes to the step indicated at 67.

At step 67, it is checked whether the previous consent pending commands have been withdrawn. If not, control is returned to the main loop and the "Decommission Request" routine will be executed again in the next iteration of the main loop. If, at 67, the consent pending commands have been withdrawn, the timer is restarted and control is returned to the main loop. In this case the routine will also be executed in the next iteration of the main loop.

At step 66, if the tampering-decommission flag is set, the count of tampered sites is reset to zero. The algorithm then continues to the step indicated at 68 in which the communication channels to the missile in question are closed and the missile is removed from the system. Next, the algorithm continues to the step indicated at 69 in which the tampering, the decommission, and the tampering-decommission flags are reset. Next, the "Decommission Request" routine is exited and control is returned to the main loop.

At step 65, it is checked whether the tampering-decommission flag is set. If it is, the algorithm proceeds to step 68, continues to step 69, and then exits the routine. If the tampering-decommission flag is not set at step 65, the algorithm goes to step 69 and then exits the routine. It should be noted that if a decommission request is made for more than one missile, then the routine is executed for each missile sequentially.

Figure 6:
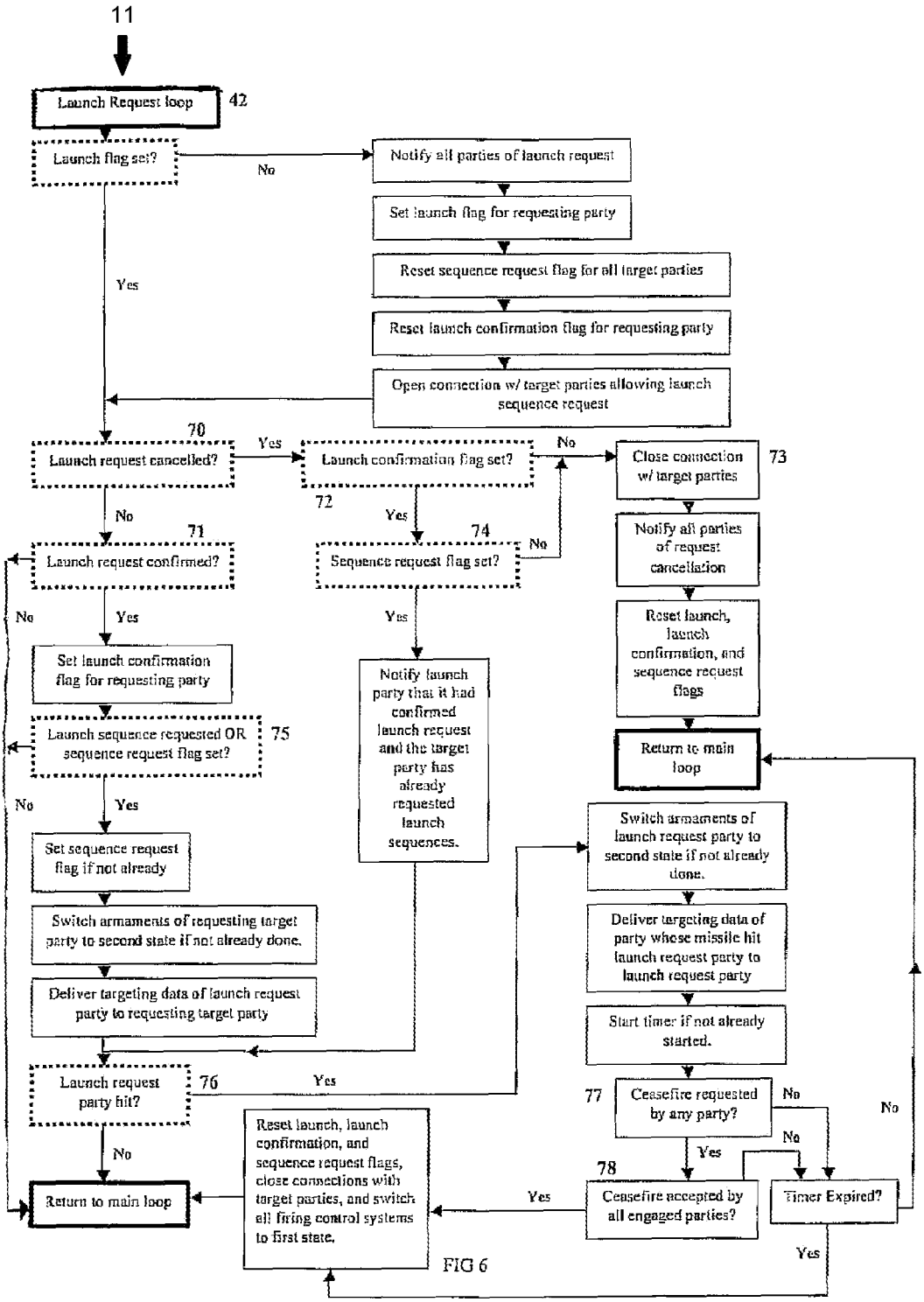

As indicated at 40 and 42 of FIG. 3, a terminal launch request causes the "Launch Request" routine to be executed. This algorithm is also executed if a launch flag, to be described subsequently, is set. The flow diagram for the "Launch Request" algorithm is depicted in FIG. 6.

Initially, the algorithm checks as to whether the requesting party is in compliance with the armament periodic destruction rules of the protocol. If it is not, a message is sent to all parties as to the request and its denial.

If the requesting party is in compliance, this algorithm checks whether the launch flag is set. If it is, the algorithm proceeds to the step indicated at 70. When the routine is executed for the first time after the request, the launch flag will not be set (it is initialized to false). If the launch flag is not set, the following actions are taken before continuing with the normal operation of the routine. First, all other parties are notified of the request. Specifically, they are notified of the identity of the requesting party, and the identity of the intended target parties. Then, the launch flag is set, and the sequence request flag and launch confirmation flag are reset (to false). The sequence reset flag serves to indicate whether the intended target parties have requested the launch codes for their armaments from the CCCS. The launch confirmation flag serves to indicate whether the first-strike requesting party has confirmed their request for a first-strike. Finally, a communication channel between the target parties and the CCCS is opened through which the target parties can request the launch codes for their armaments.

At the next step, indicated at 70, it is checked to see whether the initiating party has cancelled their launch request. If not, the algorithm proceeds to the step indicated at 71 where it checks to see if the initiating party has confirmed the launch request. If, at 70 the launch request has been cancelled, the algorithm proceeds to 72 where it checks if the launch confirmation flag is set. If not the algorithm proceeds to 73. If at 72 the initiating party has confirmed the launch request, the algorithm checks at 74 if the sequence request flag is set for any party. That is, it checks to see if any target party has requested the launch codes for its armaments from the CCCS. If so, the CCCS notifies the initiating first-strike requesting party that it is too late to cancel its launch request, and that at least one of the target parties has received its launch codes and had the firing control system of its armaments switched to the second state. The algorithm then proceeds to 76. If at 74 no target party has its sequence request flag set, the algorithm proceeds to 73.

At 73 the CCCS starts the process of retreating to the initial state that existed before any first-strike launch request was made. The CCCS closes the communication channel with the target parties through which they could request the launch codes of their armaments. All parties are then notified of the launch cancellation. The launch flag, launch confirmation flag, and sequence request flag are all reset (to false). The algorithm then returns to the main program of FIG. 3.

At 71, reached by the absence of a launch request cancellation at 70, the algorithm checks to see whether the initial first-strike launch request has been confirmed. If not, the algorithm returns to the main program of FIG. 3. If the launch request has been confirmed at 71, the algorithm sets the launch confirmation flag and proceeds to 75 where it checks to see if the target parties are requesting the launch codes, or if the sequence request flag has already been set. If neither the launch codes are requested nor the sequence request flag is set, the algorithm returns to the main program of FIG. 3. Otherwise, the algorithm proceeds to set the sequence request flag and switch the firing control system of the sequence requesting parties' armaments to the second state, if it has not already done so. The CCCS then delivers the targeting data corresponding to the initiating first-strike request party to those target parties that requested launch codes and have the firing control system of their armaments switched to the second state. The algorithm then proceeds to 76.

At 76, the CCCS checks if any missiles launched by a target party at the first-strike requesting party have detonated. If so, the launch sequences are sent to the firing control system of the first-strike requesting party's armaments, and the firing control system is switched to the second state. Further, the targeting data corresponding to the target parties' whose missiles had detonated is delivered to the firing control system of the first-strike launch request party. A timer set for a predetermined period of time is then started and the algorithm then proceeds to 77. If at 76 no target party missiles have detonated, the algorithm returns to the main program of FIG. 3.

At 77, the CCCS checks whether any of the engaged parties have made a request for a ceasefire. If so, the algorithm proceeds to 78 where it waits for a predetermined period of time and then checks if all the other engaged parties have accepted the ceasefire. If so, the CCCS resets the launch, launch confirmation and sequence request flags of all parties, closes its connection with the target parties, and switches the firing control systems of all parties to the first state. The algorithm then returns to the main program of FIG. 3. If at 77 no ceasefire has been requested or at 78 not all parties have accepted a proposed ceasefire, the CCCS checks whether the timer has expired. If so the CCCS resets the launch, launch confirmation and sequence request flags of all parties, closes its connection with the target parties, and switches the firing control systems of all parties to the first state. If the timer has not expired, the algorithm returns to the main loop of FIG. 3.

Alternate embodiments of the system may require multiple launch confirmations by the first-strike requesting party before further action is taken. Such embodiments may introduce breaks in the algorithm, wherein, if the first-strike requesting party does not confirm or re-confirm its launch request, all firing control systems will remain locked in the first state, and the algorithm will return to the main loop of FIG. 3.

Finally, as indicated at 44 and 46 of FIG. 3, a terminal access code change request causes the "Access Code Change" routine to be executed. The algorithm for this routine is depicted in FIG. 7. As described earlier, each terminal requires entry of an access code in order to communicate with other components of the system. When making an access code change request, the user must also supply the new access code. The algorithm simply changes that terminals access code in the memory of the CCCS and notifies the requester of the change. The algorithm is then exited and control is returned to the main loop.

The above algorithms describe the general flow of operation of the CCCS. The preferred embodiment of the present invention also includes some communication from the CCCS to the command terminals that is not explicitly shown in the above algorithms. This communication includes reporting the status of any activated timers, reporting the current status of the flags and counters, and the echoing of commands using the same routing procedure as described earlier. As previously stated, the routines are to be run in parallel execution. For multiple missiles, each missile will have unique flags, timers, and generate unique decisions.

A few alternate embodiments of the present invention along with innovations used in conjunction with these embodiments will presently be described. As opposed to the embodiment of FIG. 2 in which only one CCCS is employed, an alternate embodiment of the present invention show in FIG. 13 may comprise a redundant system of distributed control computer system satellites 20' that are used in order to increase the reliability of the system when performing the necessary surveillance, communication, and computational tasks. Three control computer system (CCS) satellites 20' are shown in this embodiment, but any number of CCS satellites may be used. Each of these CCS satellites 20' are deployed so as to be in direct communications with each other as well as with one or more relay satellites 24. Preferably, the minimum number of relay satellites is determined by the geographical area in which the missiles of the system are deployed. The relay satellites 24 deliver all messages received from the command terminals 14, the missile interfaces 18, surveillance satellites 26 and earth-based relay stations 28 to each CCS satellite 20'. Each one of these satellites 20' receives identical information, carries out the same computation and passes the same messages to the destination component.

To use this redundancy for increased reliability, the relay satellites 24, the earth-based relay stations 28, the missile sites, terminals, and surveillance satellites 26 must arbitrate between possibly conflicting information. Referring now to FIG. 8, there is shown a logic flow diagram of an algorithm illustrating how each of these components resolves discrepancies between messages received from different control computer satellites 20'. After receiving the messages from different sources, such as control satellites, the components determine whether the information contained therein is conflicting 80. If the information from different control satellites is identical, then the component takes the appropriate action at step 82. If there is a discrepancy, the component determines whether there is a plurality of one message 84. If there is a plurality, the component takes action based on the plurality 86. If there is no plurality, the component takes action based on the information received from the command satellite designated as the primary satellite 88. If there is only a single source of the message, as in a system with only one CCCS satellite, there can be no conflict of information. To account for the possibility of a control satellite having a faulty communication or even a total failure of communication, all components of the system make valid decisions upon receiving conflicting information.

Figure 13:
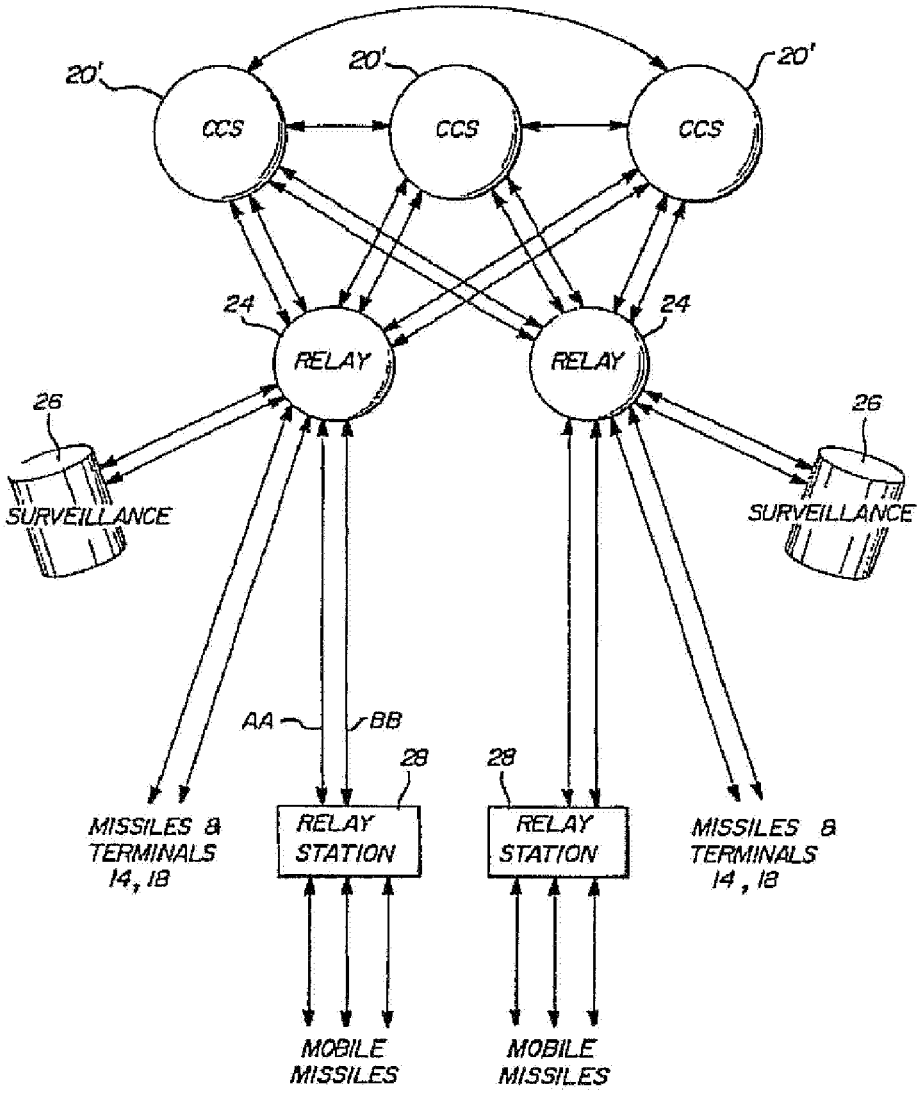
FIG. 13 is a schematic diagram of an alternative embodiment of the satellite communication system in FIG. 1 including distributed control.

Referring back to FIGS. 2 and 13, the CCCS 20 and the distributed control computer system 20' communicate with relay satellites 24. In the alternative embodiment of FIG. 13, the relay satellites 24 communicate with each of the CCCSs 20' in the distributed system. As shown in FIG. 13, the components of the system may communicate on redundant communication paths as indicated, for example, by the lines A-- and B-- between space-based relay station 24 and earth-based relay station 28. This redundancy in communication links between any two components ensures that the transmitted message is received at the destination location. The relay satellites 24 provide means for communication between the CCCS 20 and the missiles 16, the terminals 14, surveillance satellites 26 or earth-based relay stations 28. The relay satellites 24 maintain unique encryption key data for each channel of communication. The relay satellites 24 receive messages from the command satellites 20 which contain, among other things, information as to which frequency band and encryption key to utilize as shown in FIG. 9. In this embodiment the algorithm of FIG. 3 is performed by each of the CCS satellites 20', and each CCS satellite 20' dictates action based on its own computations.

In the alternative embodiment shown in FIG. 13, multiple paths are available and used between two directly linked components as discussed previously. For example, a relay satellite 24' could use two or more separate channels to send messages to one CCS 20'. In this case, redundant messages can be sent over the two or more channels. Each channel is separately maintained and the destination arbitrates multiple-path discrepancies in the same manner as described above. For each of the two or more paths from the relay satellite 24' to the CCS 20', there is an associated channel from the CCS 20' to the relay satellite 24'.

Figure 14:
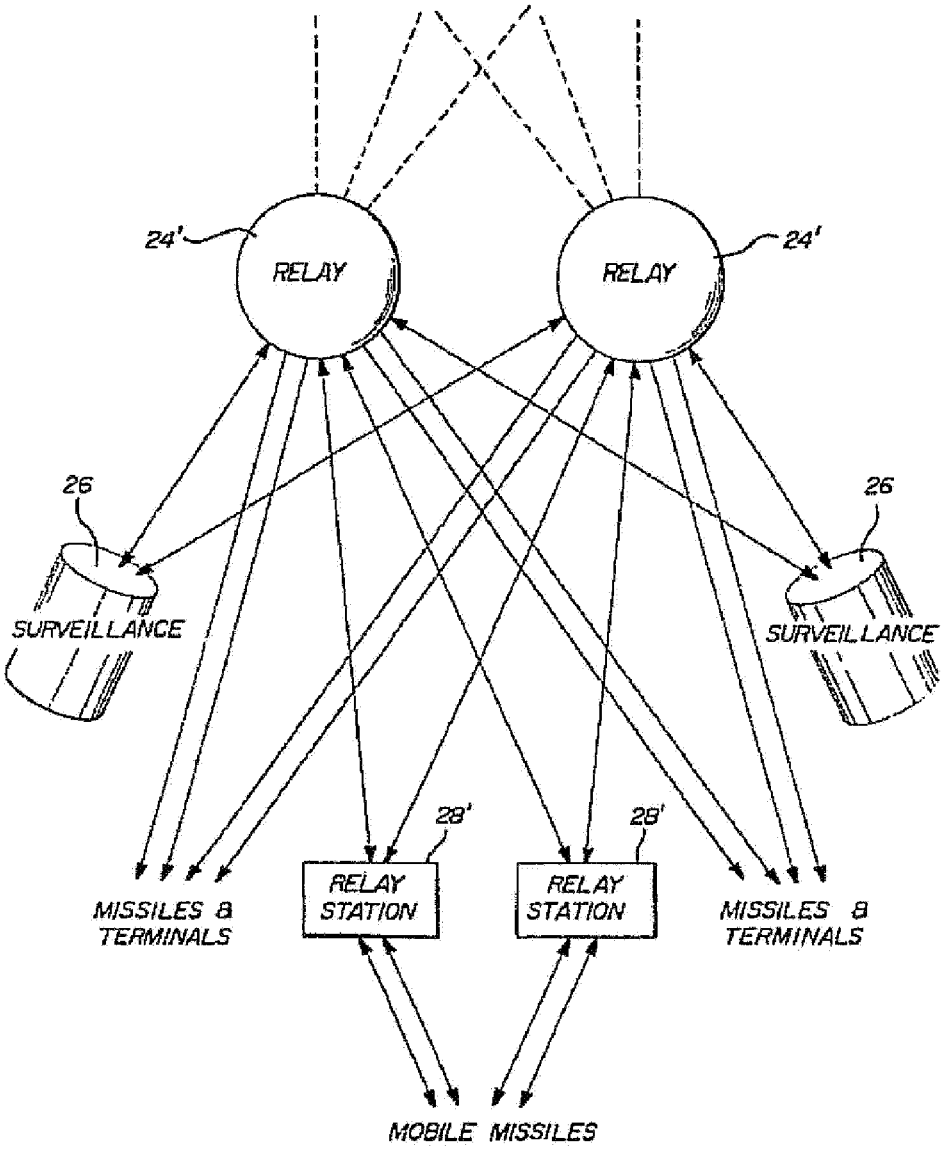
FIG. 14 is a schematic diagram of an alternative embodiment of the communication system in FIG. 1 utilizing multiple relay communication paths.

FIG. 14 depicts another alternative embodiment of the system shown in FIG. 2, wherein an earth-based relay station 28, a terminal or missile site is in direct communication with more than one relay satellite 24'. In this embodiment the relay satellites 24' carry out identical functions as previously described. The number of possible routing paths as well as the number of necessary communication channels are increased however.

Information networking techniques are necessary to control the communication between the different satellites, computers, missiles, and terminals. The networking of messages is carried out through originator and destination information contained in the messages through the earlier described routing procedures. When a message arrives at a destination, the originator of the message is immediately known regardless of the links over which the message has traveled. The message itself contains all the necessary routing information as shown in FIG. 9. For example, a message sent by a control satellite to a mobile missile destination would tell a relay satellite which earth-based relay station is to receive the message. The message also contains information telling the earth-based relay station which missile site the information must go. Thus, the steering of information, regardless of the path used, is controlled by the originator of the message. Where there is more than one possible path between the source and the destination of a message as shown in FIG. 14, redundant messages can be sent through the multiple paths, thus increasing reliability of the system. That is, if the destination can be reached through multiple relay stations or relay satellites, all possible paths of communication can be used.

Figure 10:
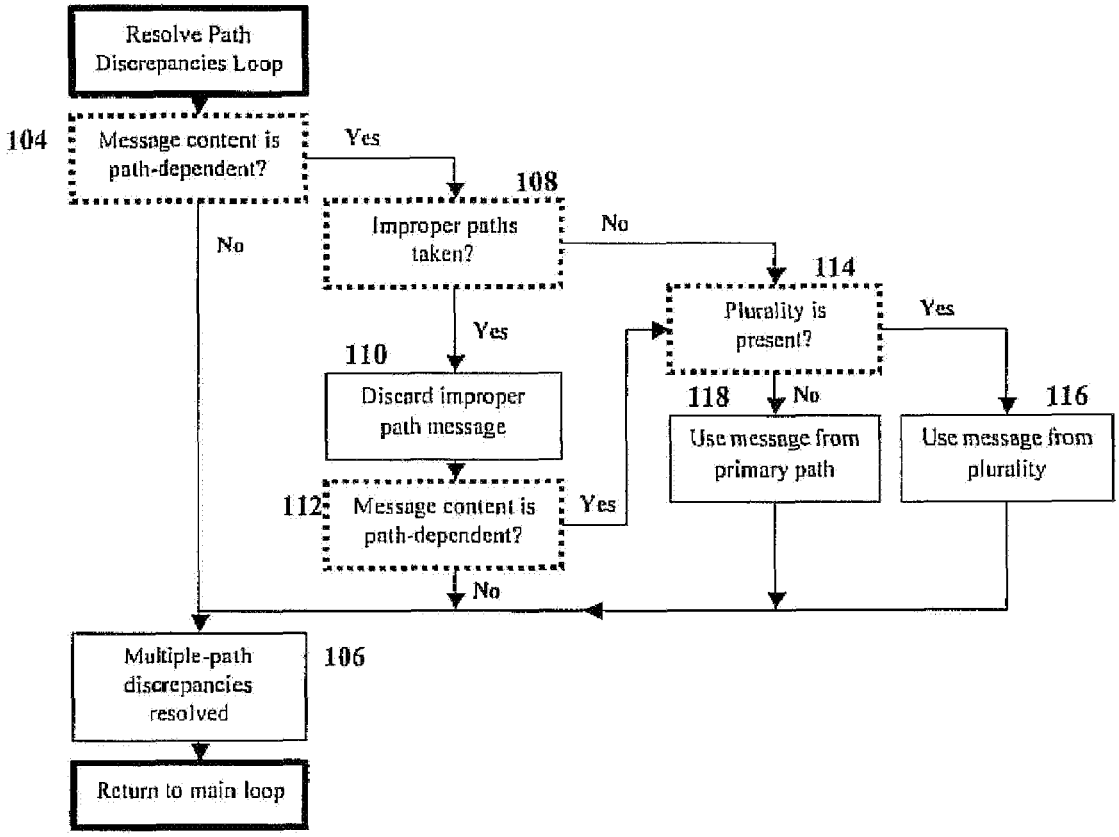
FIG. 10 is a logic flow diagram of a communications path discrepancy resolution diagram.

The destination component must be able to arbitrate the meaning of messages whose content varies over the path but which originated at the same source. This arbitration process is shown by the logic flow diagram of FIG. 10, and is carried out to assure the integrity of the communication paths when the multiple path embodiment of FIG. 14 is deployed. As shown in FIG. 10, an incoming message is received by a system component over one or more paths 104. If the message is identical over all paths, then multiple path discrepancies have been resolved and the content of the message is further evaluated as shown at step 80 of FIG. 8. (Note: there can be no conflict if a single communication path is used).

If the message from a source varies over the path taken, the destination component's control logic must arbitrate to determine the valid message sent by the source. At step 108, if any message has arrived over an improper path, i.e., the path of communication for the message did not correspond to the path specified in the message, then this message is discarded, step 110. As stated earlier in reference to FIG. 9, if a relay satellite or a relay station receives a message over a channel other than that specified, it appends this information to the received message before retransmitting. If a message is thus discarded, the algorithm checks whether a discrepancy still exists 112. If not, the message can be further evaluated at step 106. If a discrepancy still exists, the control logic determines at step 114 is there is a plurality of paths which brought the same message. At step 116, if the plurality of paths is present, the message is attributed to the source and the message can be further evaluated at step 106. If a plurality of paths is not present, the message attributed to the source will be that one received over the primary communication path, step 118. The primary path is designated as such by the control logic as the most direct and reliable path of communications.

In order to further ensure the security and integrity of the communication channels between satellites, command terminals, missiles and other linked components, the preferred embodiment of the present invention utilizes a communication channel management system where the communication interfaces between linked components are capable of communicating at different frequency bands. A unique frequency bandwidth is assigned for each channel of communication between every set of linked components within the present invention which communicate. For each link, a particular carrier frequency is chosen at any time from the bandwidth appropriated for that link. This bandwidth is assigned such that no bandwidths of one link overlaps with the bandwidth of any other link, thus eliminating intercomponent interference. Also, these carrier frequencies are perpetually changed to maintain the secrecy of communications. Similarly, unique data encryption keys are maintained for each communication channel. These encryption keys are also continuously changed simultaneously with the changing of the frequency bands.

Allocation of a frequency bandwidth is made from a set of carrier frequencies that linked components are capable of communicating on. For each communication link, one component is responsible for selecting carrier bandwidth and encryption keys from the appropriate possibilities. This component is known as the master. The linked component which responds to that selection is known as a slave. For example, the CCCS component is a master component when linked to a relay satellite, which would then be a slave. A relay satellite would be a master component when linked to any of its corresponding slave components such as surveillance satellites, relay stations, terminals or missile sites. The relay station is a master component when linked to the missile site, a slave component. Between two linked CCCSs of FIG. 13, the master component is designated arbitrarily.

Figure 11:
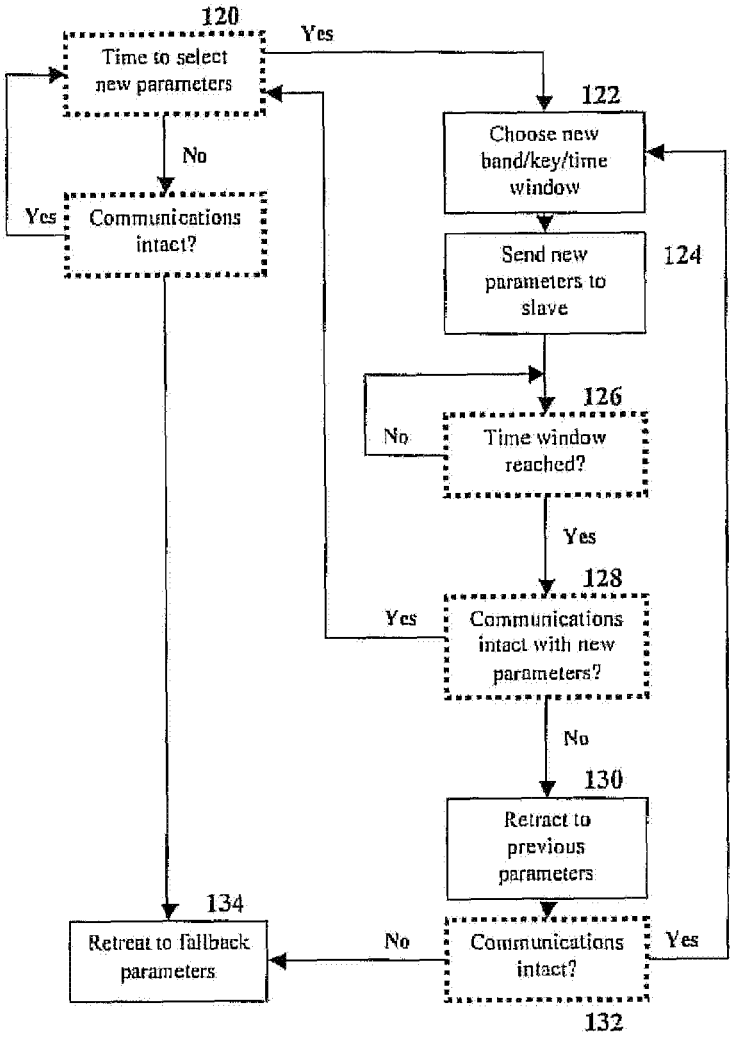
FIGS. 11 and 12 are logic flow diagrams of communication parameter selection algorithms utilized by the system components in the present invention.
Figure 12:
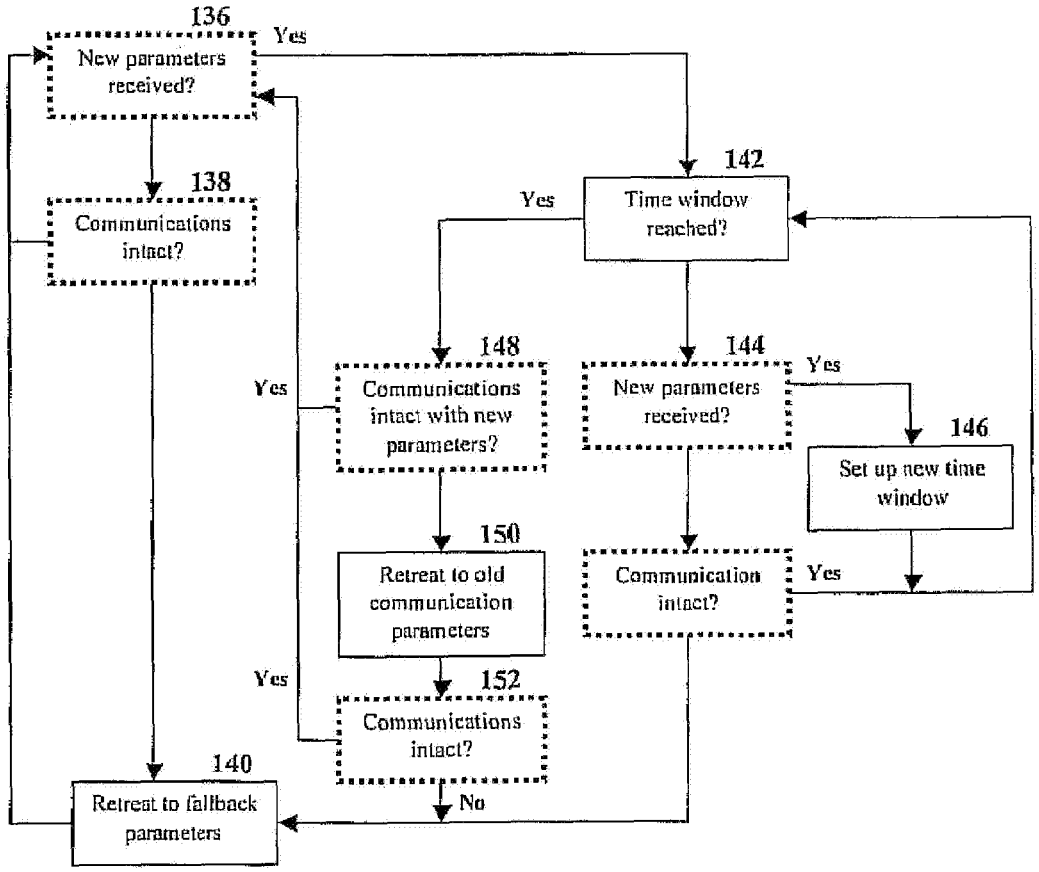

Referring now to FIGS. 11 and 12, there are shown logic flow diagrams of communication parameter selection algorithms used by the master and slave links in a communication link. The communication parameter selection algorithm is executed by the control logic concurrently for each communication channel. In the relay satellites, the relay stations, and the CCCSs which have slave channel links, the algorithms of FIGS. 11 and 12 will be concurrently executed, each applying to different command channels.

Two linked components within the system communicate on two separate communication channels having separate communication parameters. For example, a relay satellite transmits messages to a missile site on one communication channel and receives messages from the missile site on a completely different channel, thus establishing a two-way link between the two components. The master component, such as the relay satellite from the above example, selects the communication parameters, including frequencies, encryption keys and time window, for both communication channels. If there is more than one two-way link between two components, the algorithm for the separate two-way links are executed separately. The frequency band and the encryption key data are passed as messages form the master component to the slave component. These messages also contain a time window indicating when use of the new frequency and encryption data will begin.

As shown in FIG. 11, when a new set of communication parameters are selected by the master component, the master sends them as a message to the slave component. The master continues to send status information messages to the slave, maintaining normal communications with the present parameters, until the time window is reached at step 126. At that time, any message received or sent will use the new communication parameters. If, at step 138, messages are received intact after the time window expires, that is, status or other messages arrived regularly on that frequency and the deciphered messages are valid ones, then the algorithm for that channel returns to the beginning of the algorithm step 120. If, however, messages are not received intact at the new time window, the two links of the master retreat to the previous parameters as shown at step 130. If the messages received are valid, then the algorithm returns to step 122. If the receiving communication link is not intact at step 132, the master retreats to the fallback parameters shown as step 134. These fallback parameters are set up to be used only in the case that communications are down. They do not change and they are used only long enough to reestablish communications with the new parameters at step 122.

The algorithm of FIG. 12 is executed for all links designated as slave links or slave components. For any set of two-way slave links, encryption key and frequency band use remain the same as long as no new parameters are received as shown at step 136. If communications are not intact at step 138, then the associated receiving and transmitting parameters retreat to the fallback parameters at step 140. If new parameters are received at step 136, the slave continues normal communication while awaiting the expiration of the time window step 142. At step 144, if new parameters are received before the time window expires, the new time window is set up at step 146 and the control remains in the loop. If the new time window is reached at step 142, the new parameters are set up for transmission and receiving. If the receiving channel receives valid messages as shown at step 148, then control returns to the top of the loop, step 136, otherwise the slave retreats to the old parameters, step 150. If, at step 152, these messages are received intact the algorithm returns to the top of the loop step 136. If the valid messages are not received at step 152, the slave retreats to its fallback parameters at step 140. If communications drop out before the time window is reached, the control logic retreats to the fallback parameters at step 140.

As described above, if communications are not intact, the master resumes communications with the previous parameters. If the previous parameters are not intact, the master retreats to the fallback parameters. The slave, when not receiving valid messages from the master, retreats to previous parameters and, if necessary, retreats to the fallback parameters also. In this way, the slave can communicate to the master that is not receiving valid messages. This scheme enables recovery given the possibility of interference on a certain frequency band. It also allows recovery from the possibility that communication parameters are incorrectly transmitted by the master or incorrectly interpreted by the slave. The fallback bands and fallback encryption key data are only used in the event of interfering signals or disruption of communication links for other reasons, and are only used as back-up frequencies, meaning that these frequencies cannot be used by the channel in normal operation.

In an alternative embodiment, a spread spectrum communication technique may be employed using a code division multiple access protocol, with the channels hopping frequencies, to ensure secure links. In this embodiment, any change in the carrier frequency band will be done as previously stated.

To further preserve the integrity of the signals, digital messages are encoded with additional error detection and correction bits. A message to be transmitted is created as a digital bit sequence. As shown in FIG. 9, the source, destination and routing information are appended to the message at its creation. The message is then encrypted at step 98 and manipulated to contain error correction bits at step 100. Upon receipt of the message at any site, the message is demodulated to a digital bit stream and that bit stream is checked against the error detection/correction bits. If a reconcilable error is detected, it is then corrected. This greatly increases the error detection and correction of the transmitted messages. A message received by a relay station or relay satellite which is to be passed on must, after encrypting the message with the appropriate encryption key, encode the message to include error correction bits. All satellite interfaces are capable of encoding and decoding these messages, and a common error correction algorithm is used by all components of the system.

In an alternative embodiment, the mutual missile control system can be used in conjunction with an anti-missile defense system. In this embodiment, the two systems cooperate so that a missile launched through the proper channels provided by the mutual missile control system as described above will not be destroyed by the anti-missile defense system. Missiles launched outside the authority of the mutual missile control system, or rogue missiles, will be eliminated by the defense system to its full abilities. Rogue missiles include missiles not integrated into the mutual missile control system such as missiles possessed by a party not integrated into the mutual missile control system, missiles which have been decommissioned, or missiles that have been tampered with and were launched without authorization of the mutual missile control system.

Figure 15:
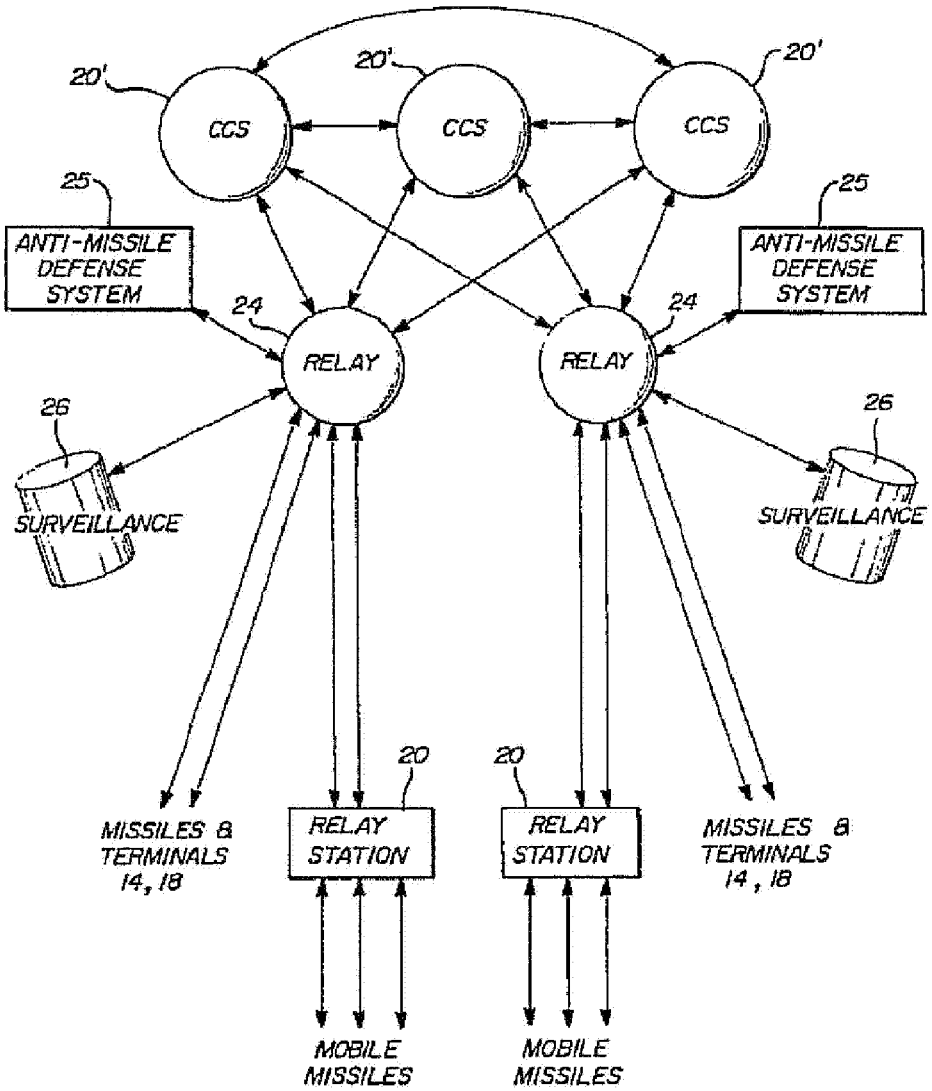
FIG. 15 is a schematic diagram of an alternative embodiment of the satellite communication system of FIG. 13.

Referring now to FIG. 15, there is shown a schematic diagram of this alternative embodiment utilizing the mutual missile control system depicted in FIG. 13. The embodiment of FIG. 15 provides an interface between the global missile control system and an anti-missile defense system 25. This interface consists of communication channels from relay satellites 24 to the anti-missile defense system 25 as well as additional communication channels from relay satellite 24 to the control satellites 20'. In this embodiment, after a missile has been properly launched as authorized by the mutual missile control system, the CCS 20' pass this information to the defense system 25 through relay satellite 24. Information such as the location of origin of the fired missile, the time of the launch, the type of missile, the number of warheads and any other information kept by control satellite 20' about the missile is sent as a message to the defense system 25. The message is transmitted through relay satellites 24 which route the message onto the proper communication channels linked to the defense system 25. All messages sent to defensive system 25 from control satellites 20' are in the same format as messages used within the mutual missile control system as described above. Communications to the defensive system 25 are handled and routed identically as messages within the mutual missile control system. Relay satellites 24 are responsible for selecting carrier frequency and encryption key data. Relay satellites 24 communicate these selections to the defensive system in the same way as it communicates them to the earth-based relay stations as described previously and shown with reference to FIG. 9.

If a missile is launched validly through the global missile control system, the CCS 20' will send to the defense system 25 a message requesting that the defense system 25 not destroy the missile. If the missile is silo-based, the location of the missile is also sent.

In the case that a missile launch not authorized by the CCS 20' is detected by mutual missile control system surveillance satellites 26, the launched missile is a rogue. The CCS 20' will pass this information to the defense system 25, and the defense system 25 can take all possible steps to destroy the rogue missile. In the case where the defense system 25 detects a missile launch and receives no information from the mutual missile control system, the defense system infers that a rogue missile has been launched.

The present invention need not be limited to the orbiting satellite system of the preferred embodiment. Alternatively, the central control computer system may be stationed on land remote from the territories of the adversaries. Many different systems may be employed to defend such a remote station.

Having thus described my invention, I claim:

1. A system to control the firing of a plurality of armaments, each armament comprising a firing control system having a first normal inactive state wherein the armament is prevented from being fired, a second active state wherein firing of the armament is enabled, and each armament requiring targeting data in order to be launched to a specific location, control of the armaments being divided between a plurality of parties each of which is under an obligation to periodically destroy some of its armaments, comprising:

a central computer remote from the territories of the parties;

a plurality of computer terminals, one under the control of each of the parties;

a first communication channel between the central computer and each of said computer terminals and a second communication channel between the firing control system of each of the armaments and at least one of the central computer or the computer terminal controlling such armaments;

a program in each of said computer terminals for transmitting a request from any of said computer terminals to said central computer, said request specifying that the firing control systems of the armaments controlled by the requesting terminal be switched from said first state to said second state and said request identifying the target parties whom the armaments are intended to target;

a program in said central computer, operative, upon receipt of said request from the terminal of a first of said parties, to: (1) make a determination as to whether the requesting party is in compliance with its obligation to destroy some of its armaments and to proceed with the following steps only if the requesting party is in compliance, (2) transmit a signal to all parties notifying them of the request made by the first party, the identification of the first party, and the identification of the target parties, (3) upon confirmation or multiple confirmations of said request by the first party and upon request of a target party, to switch said target party's firing control systems from said first state to said second state, (4) upon cancellation of initial request by said first party, to switch said firing control systems of all said target parties from said second state to said first state, and (5) upon impact of missiles launched by a target party onto said first party, to switch said firing control system of said first party from said first state to said second state.

2. The system of claim 1, wherein the determination as to whether the requesting party is in compliance with its obligation to destroy certain of its armaments is made by inspectors independent of the requesting party authorized to inspect the requesting party's armaments.

3. The system of claim 1, wherein the obligation to periodically destroy certain of its armaments continues until a party's armaments reach a predetermined minimum number.

4. The system of claim 1, wherein switching of a party's firing control systems from said first state to said second state, comprises delivery of said targeting data of the armaments to said firing control system.

5. The system of claim 1 wherein switching of said armaments from said first to said second state comprises the release of launch codes by said central computer to said armaments.

6. The system of claim 1 further comprising a program in said central computer, operative upon receipt of a request by one of said parties, to switch the firing control systems of all parties to the said first state upon the consent of all parties whose firing control systems are not already in the first state.

7. The system of claim 1 further comprising a program in said central computer to switch the firing control systems of all parties to the said first state after a predetermined time following switching of the firing control system of the said first party to the said second state.

8. The system of claim 1 further including means for establishing communication channels between said central computer and an anti-missile defense system.

9. A system as set forth in claim 8 wherein said anti-missile defense system is programmed to neither intercept nor destroy any armaments controlled by the central computer or launched under permission of the central computer.

10. A system as set forth in claim 1 wherein said central computer is disposed on an orbiting satellite.

11. A system as set forth in claim 1 further including a computer means disposed on each of the armaments to monitor the status thereof.

12. A system as set forth in claim 1 further including means operatively associated with at least one of said armaments to detect tampering.

13. A system as set forth in claim 12 further including means adapted to communicate detected tampering to said central computer.

14. A system as set forth in claim 1 wherein said central computer includes means for detonation of said armament upon detection of tampering.

15. A system as set forth in claim 1 wherein said central computer includes means to decommission any of said armaments.

16. A system as set forth in claim 1 wherein each of said armaments include means to receive a unique firing code from said firing control systems, whereby said firing codes are required to be communicated to said armaments in order for the state of said systems to be changed from said inactive state to said active state.

* * * * *